US007900610B2

(12) United States Patent
Okawa et al.

(10) Patent No.: US 7,900,610 B2
(45) Date of Patent: Mar. 8, 2011

(54) SWITCHING VALVE FOR EGR COOLER

(75) Inventors: Akira Okawa, Nisshin (JP); Makoto Hatano, Nagoya (JP)

(73) Assignee: Aisan Kogyo Kabushiki Kaisha, Obu-Shi (JP)

( * ) Notice: Subject to any disclaimer, the term of this patent is extended or adjusted under 35 U.S.C. 154(b) by 0 days.

(21) Appl. No.: 12/585,148

(22) Filed: Sep. 4, 2009

(65) Prior Publication Data

US 2010/0126478 A1 May 27, 2010

(30) Foreign Application Priority Data

Nov. 24, 2008 (JP) ..... 2008-298883

(51) Int. Cl.
*F02M 25/07* (2006.01)
*F02B 47/08* (2006.01)
*F02D 23/00* (2006.01)

(52) U.S. Cl. ..... 123/568.12; 123/568.24

(58) Field of Classification Search ..... 123/568.11, 123/568.12, 568.2, 568.21, 568.23, 568.24, 123/563; 60/599, 605.2; 29/726
See application file for complete search history.

(56) References Cited

U.S. PATENT DOCUMENTS

| | | | | |
|---|---|---|---|---|
| 3,191,628 | A * | 6/1965 | Kirkwood et al. | 137/625.43 |
| 3,211,217 | A * | 10/1965 | McKee et al. | 165/95 |
| 3,973,592 | A * | 8/1976 | Cleaver et al. | 137/625.43 |
| 4,520,847 | A * | 6/1985 | Baron | 137/625.43 |
| 4,543,996 | A * | 10/1985 | Baron | 137/625.43 |
| 6,401,754 | B1 * | 6/2002 | Winquist et al. | 137/625.47 |
| 6,675,572 | B2 * | 1/2004 | Everingham et al. | 60/278 |
| 6,955,213 | B2 * | 10/2005 | Stonehouse et al. | 165/103 |
| 7,077,114 | B2 * | 7/2006 | Husges | 123/568.12 |
| 7,117,882 | B2 * | 10/2006 | Blomgren | 137/311 |
| 7,281,529 | B2 * | 10/2007 | Lew et al. | 123/568.12 |
| 7,438,062 | B2 * | 10/2008 | Okawa et al. | 123/568.12 |
| 7,581,533 | B1 * | 9/2009 | Moran | 123/568.12 |
| 7,770,563 | B2 * | 8/2010 | Hamadani et al. | 123/568.12 |
| 2008/0184974 | A1 * | 8/2008 | Kobayashi et al. | 123/568.12 |
| 2008/0289611 | A1 * | 11/2008 | Modien | 123/568.12 |
| 2009/0007891 | A1 * | 1/2009 | Rollet | 123/568.12 |
| 2009/0056682 | A1 * | 3/2009 | Okawa et al. | 123/568.12 |

FOREIGN PATENT DOCUMENTS

JP A-2003-520922 7/2003

* cited by examiner

*Primary Examiner* — John T Kwon
*Assistant Examiner* — Arnold Castro
(74) *Attorney, Agent, or Firm* — Oliff & Berridge, PLC

(57) ABSTRACT

A switching valve comprises a housing, a gas inflow chamber, a first passage adjacent to the inflow chamber through a first partition wall and communicating with the EGR cooler, a first communication hole providing communication between the inflow chamber and the first passage, a gas outflow passage, a second passage communicating with the outflow passage and adjacent to the inflow chamber through the second partition wall and communicating with the EGR cooler, a second communication hole formed in the second partition wall and providing communication between the inflow chamber and the second passage, and a third partition wall dividing the first passage from the second passage. The first to third partition walls are continuous at a joined portion in a Y-shaped cross section. A valve element is placed to be swingable about a point near the joined portion between the first and second partition walls. The first and second partition walls are slanted with respect to a mold-removing direction to form the inflow chamber and the third partition wall is parallel to a mold-removing direction to form the first and second passages.

5 Claims, 8 Drawing Sheets

SWITCHING VALVE FOR EGR COOLER

CROSS-REFERENCE TO RELATED APPLICATIONS

This application is based upon and claims the benefit of priority from each of the prior Japanese Patent Application No. 2008-298883 filed on Nov. 24, 2008, the entire contents of which are incorporated herein by reference.

TECHNICAL FIELD

The present invention relates to an EGR cooler for cooling EGR gas in an engine and more particularly to a switching valve for an EGR cooler to switch a flow direction of EGR gas with respect to an EGR cooler.

BACKGROUND ART

Heretofore, as a technique of the above type, there is known an exhaust gas heat-exchanger disclosed in Patent Literature 1 mentioned below. FIG. 10 is a cross sectional view of part of this heat-exchanger. This heat-exchanger includes a hollow shell 61 having an internal space and an exhaust gas manifold 62 fixed at one end of the shell 61. The exhaust gas manifold 62 includes a first exhaust gas chamber 64 and a second exhaust gas chamber 65 adjacent to each other with a baffle plate 63 interposed therebetween. The exhaust gas chamber 64 includes an exhaust gas inlet 66 and the exhaust gas chamber 65 includes an exhaust gas outlet 67, respectively. The first and second exhaust chambers 64 and 65 are partitioned by the baffle plate 63 and a flap valve element 68. The flap valve element 68 is placed to be rotatable at its one end about a pin 69. As shown by a solid line in FIG. 10, while the flap valve element 68 is placed in a closed position to close an opening 70 of the baffle plate 63, exhaust gas flowing in the first exhaust gas chamber 64 is allowed to flow into the shell 61 and then flow into the second exhaust gas chamber 65 via the shell 61 without directly flowing into the second exhaust gas chamber 65. On the other hand, as shown by a broken line in FIG. 10, while the flap valve element 68 is placed to open the opening 70, the exhaust gas flowing in the first exhaust gas chamber 64 is allowed to directly flow into the second exhaust gas chamber 65. As above, a flow direction of the exhaust gas is switched between a flow direction passing through the shell 61 and a flow direction not passing through the shell 61.

CITATION LIST

Patent Literature

Patent Literature 1: Japanese national publication No. 2003-520922

SUMMARY OF INVENTION

Technical Problem

However, in the heat-exchanger disclosed in Patent Literature 1, the exhaust gas manifold 62 has to be formed with the opening 70 in the single baffle plate 63 separating the two exhaust gas chambers 64 and 65. Thus, the exhaust gas manifold 62 could not be produced integrally by simply removing a mold. In particular, the opening 70 of the baffle plate 63 needs to be formed in a separate step. This results in an increase in the number of processes by just that much, leading to a cost increase.

The present invention has been made to solve the above problems and has a purpose to provide a switching valve for an EGR cooler to facilitate integral molding by mold removal.

Solution to Problem

To achieve the above purpose, one aspect of the present invention provides a switching valve for EGR cooler, the valve being to be provided in the EGR cooler to switch a flow direction of EGR gas with respect to the EGR cooler, the valve comprising: a valve housing molded by a mold and to be fixed to the EGR cooler; an inflow chamber formed in the valve housing so that EGR gas flows therein from an upstream side of the valve housing; a first passage formed in the valve housing to be adjacent to the inflow chamber through a first partition wall and to communicate with inside of the EGR cooler; a first communication hole formed in the first partition wall to provide communication between the inflow chamber and the first passage; an outflow passage through which EGR gas flows out of the valve housing to a downstream side thereof; a second passage formed in the valve housing to communicate with the outflow passage and be adjacent to the inflow chamber through a second partition wall, and communicate with the inside of the EGR cooler; a second communication hole formed in the second partition wall to provide communication between the inflow chamber and the second passage; a third partition wall dividing the first passage from the second passage, the first partition wall, the second partition wall, and the third partition wall being continuous to each other at a joined portion, forming a Y-shaped cross section; and a valve element placed to be swingable about a point near the joined portion between the first partition wall and the second partition wall, the valve element being swung to selectively close the first communication hole and the second communication hole, and the first partition wall and the second partition wall being slanted with respect to a mold-removing direction of a mold that forms the inflow chamber, and the third partition wall being almost parallel to a mold-removing direction of another mold that forms the first passage and the second passage.

Advantageous Effects of Invention

According to the above configuration, the valve housing of the switching valve is formed with the first partition wall having the first communication hole and the second partition wall having the second communication hole. This makes it possible to facilitate integral molding of the switching valve by mold removal using a molding mold.

DESCRIPTION OF EMBODIMENTS

First Embodiment

A detailed description of a first preferred embodiment of a switching valve for an EGR cooler embodying the present invention will now be given referring to the accompanying drawings.

Figure 1:
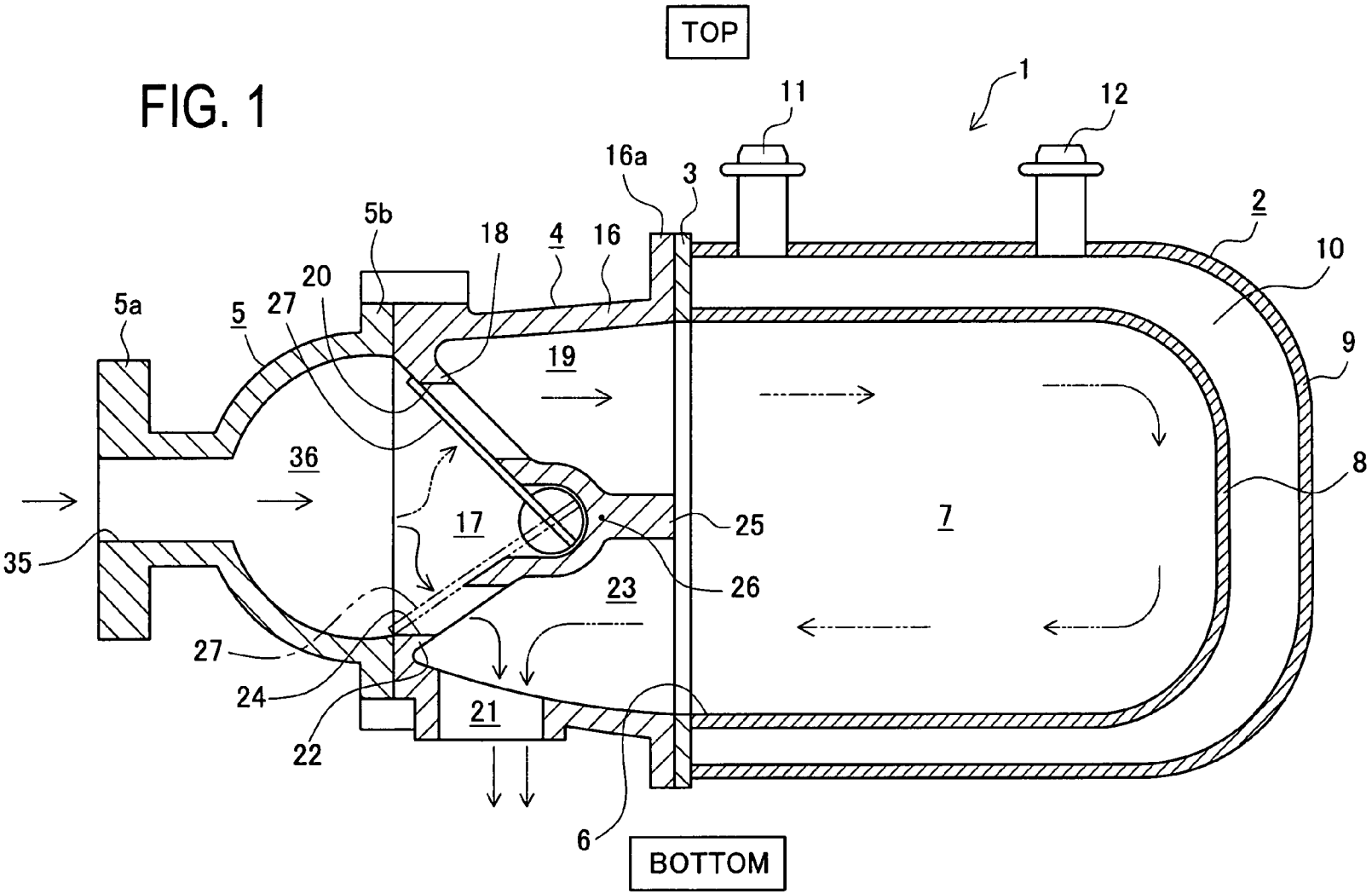
FIG. 1 is a cross sectional view of an EGR cooler device in a first embodiment.
Figure 2:
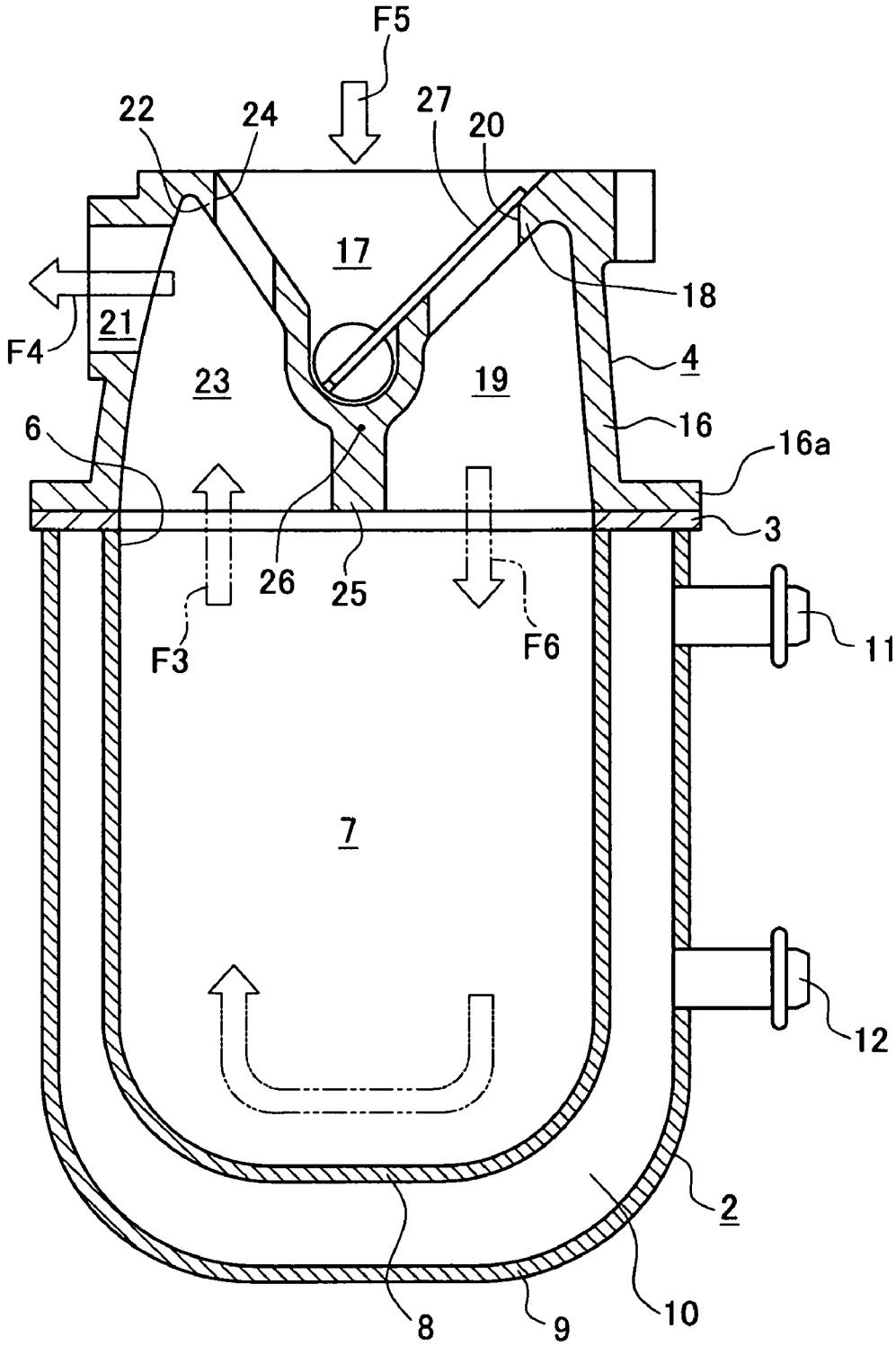
FIG. 2 is a cross sectional view showing a state where a joint pipe is removed from the EGR cooler device in the first embodiment.

FIG. 1 is a cross sectional view of an EGR cooler device 1. In use, this device is oriented with respect to "Top" and "Bottom" as shown in FIG. 1. This device 1 includes an EGR cooler 2, a switching valve 4 fixed to the EGR cooler 2 through a gasket 3 to switch a flow direction of EGR gas with respect to the EGR cooler 2, and a joint pipe 5 attached to the switching valve 4. The EGR cooler 2 and the switching valve 4 are fastened to each other with bolts or the like (not shown) and similarly the switching valve 4 and the joint pipe 5 are fastened to each other with bolts or the like (not shown). FIG. 2 is a cross sectional view showing a state where the joint pipe 5 is removed from the EGR cooler device 1.

The EGR cooler 2 has an opening 6 at one end and an almost cup shape internally having a gas chamber 7. The EGR cooler 2 has a double walled structure by an inner casing 8 and an outer casing 9. Between the casings 8 and 9, a water chamber 10 is formed to circulate cooling water. The EGR cooler 2 is provided with two pipe joints 11 and 12 each extending outward. Through those pipe joints 11 and 12, the cooling water is supplied to and discharged from the water chamber 10.

Figure 3:
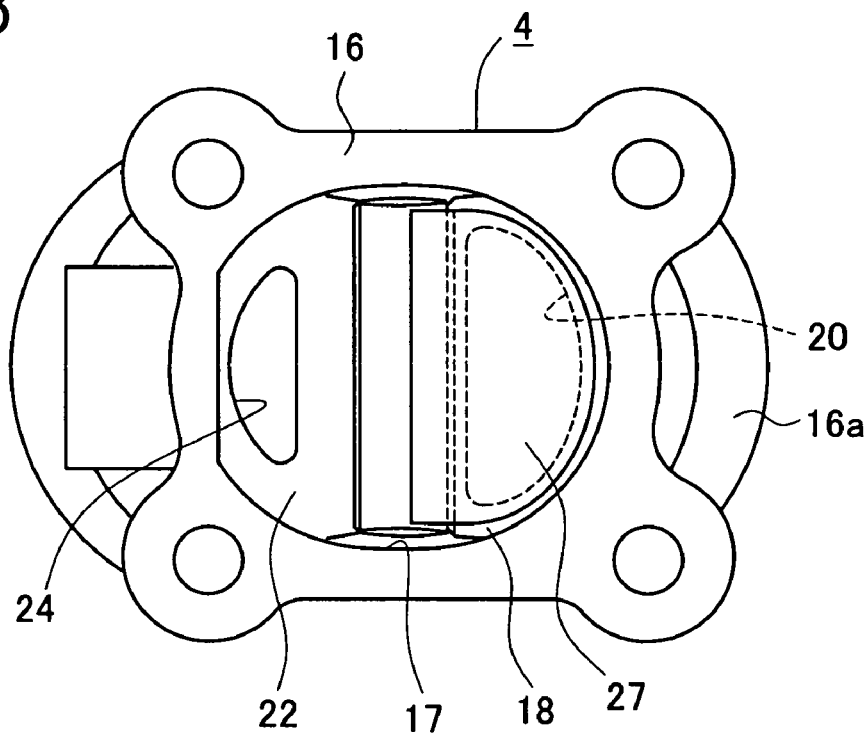
FIG. 3 is a plan view of a switching valve in the first embodiment.
Figure 4:
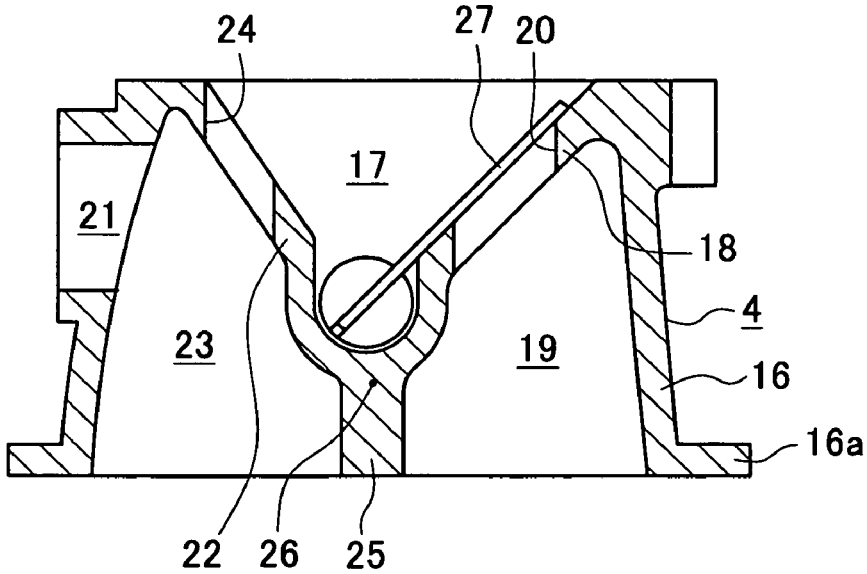
FIG. 4 is a cross sectional view of the switching valve in the first embodiment.

FIG. 3 is a plan view of the switching valve 4. FIG. 4 is a cross sectional view of the switching valve 4. The switching valve 4 includes a valve housing 16. A flange 16*a* is integrally formed at a rear end of the valve housing 16. The valve housing 16 internally includes the inflow chamber 17, a first partition wall 18, a first passage 19, a first communication hole 20, an outflow passage 21, a second passage 23, a second partition wall 22, a second communication hole 24, and a third partition wall 25. EGR gas will flow in the inflow chamber 17 from an upstream side of the valve housing 16. The first passage 19 is adjacent to the inflow chamber 17 through the first partition wall 18 and communicates with the inside of the EGR cooler 2. The first communication hole 20 is formed in the first partition wall 18 to provide communication between the inflow chamber 17 and the first passage 19. The outflow passage 21 allows the EGR gas to flow out of the valve housing 16 to a downstream side thereof. The second passage 23 communicates with the outflow passage 21, and is adjacent to the inflow chamber 17 through the second partition wall 22, and communicates with the inside of the EGR cooler 2. The second communication hole 24 is formed in the second partition wall 22 to provide communication between the inflow chamber 17 and the second passage 23. The third partition wall 25 divides the first passage 19 from the second passage 23.

The aforementioned first partition wall 18, second partition wall 22, and third partition wall 25 are joined to each other at a joined portion 26 in a Y-shaped cross section as shown in FIGS. 1, 2, and 4. A flap valve element 27 is placed to be swingable about a point near the joined portion 26 between the first partition wall 18 and the second partition wall 22. This valve element 27 is driven by an actuator (not shown) separately provided. When this valve element 27 is brought into surface contact with the first partition wall 18 or the second partition wall 22, the first communication hole 20 and the second communication hole 24 are selectively closed. Specifically, when the valve element 27 closes the first communication hole 20, the second communication hole 24 is opened. On the other hand, when the valve element 27 closes the second communication hole 24, the first communication hole 20 is opened. When the valve element 27 closes the first communication hole 20 as shown by a solid line in FIG. 1, EGR gas flowing from the upstream side into the inflow chamber 17 is allowed to flow out through the outflow passage 21 via the second communication hole 24 and the second passage 23 as indicated by solid lines with arrows without passing through the gas chamber 7 of the EGR cooler 2. On the other hand, when the valve element 27 closes the second communication hole 24 as shown by a chain double dashed line in FIG. 1, the EGR gas flowing from the upstream side into the inflow chamber 17 is allowed to flow through the gas chamber 7 of the EGR cooler 2 as indicated by double dashed lines with arrows, in which the EGR gas is cooled, and then the EGR gas is allowed to flow out through the outflow passage 21 via the second passage 23.

Figure 5:
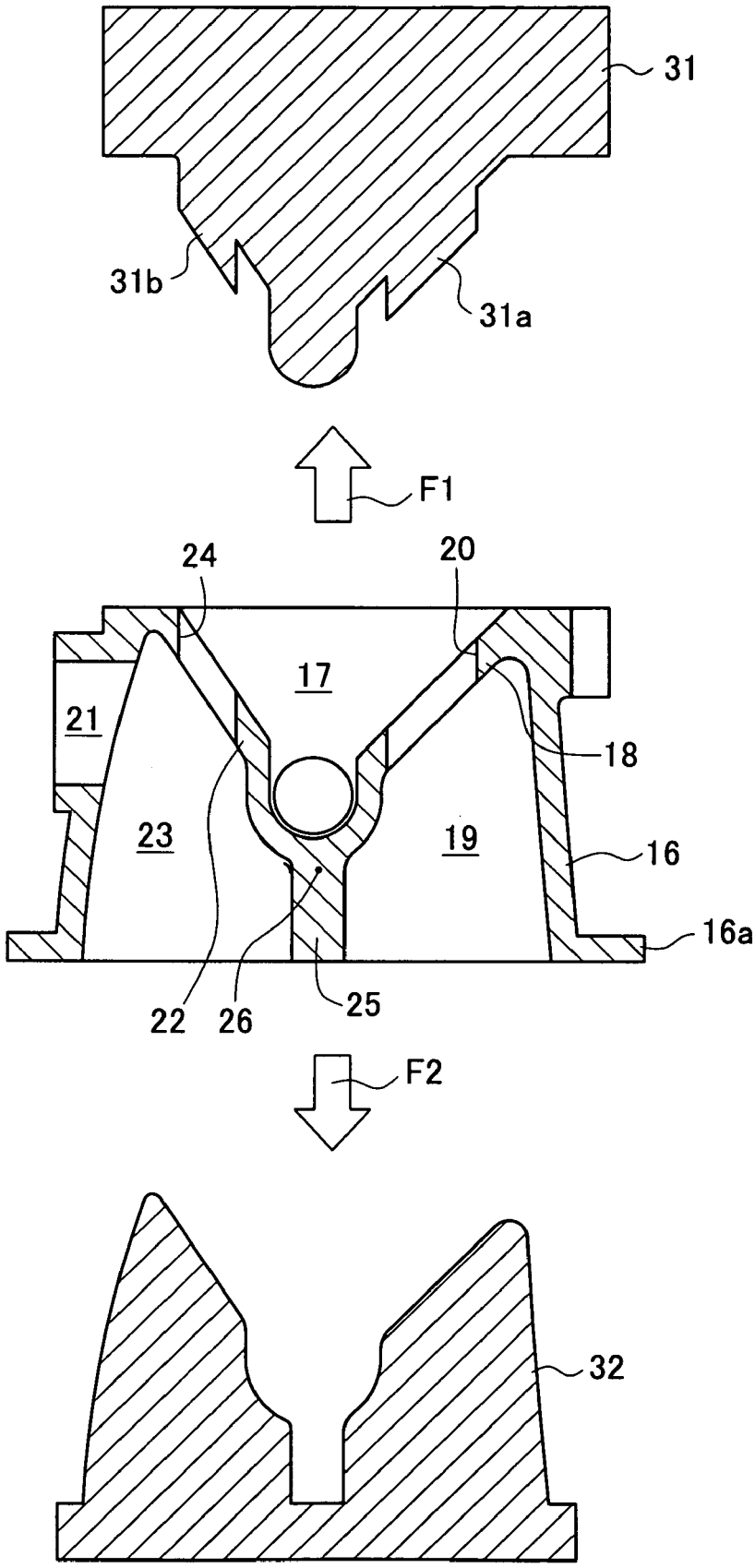
FIG. 5 is a cross sectional view showing a relationship between a valve housing and a mold for molding the housing.

FIG. 5 is a cross sectional view showing a relationship between the valve housing 16 and a first mold 31 and a second mold 32 for molding the housing 16. The housing 16 is made of metal such as aluminum by use of the first and second molds 31 and 32. The first mold 31 is configured to mainly form the inflow chamber 17 of the housing 16. The second mold 32 is configured to mainly form the first passage 19 and the second passage 23 of the housing 16. The first mold 31 is integrally formed with molding parts 31*a* and 31*b* for forming the first communication hole 20 and the second communication hole 24. Both the molds 31 and 32 are clamped and between them molten metal is supplied. Thus, the first partition wall 18, second partition wall 22, and third partition wall 25 are formed continuously in the Y-shaped cross section. In addition, the first partition wall 18 and the second partition wall 22 are formed with the first communication hole 20 and the second communication hole 24 respectively. Herein, the first partition wall 18 and the second partition wall 22 are slanted in a bifurcated form with respect to a mold-removing direction F1 of the first mold 31 that forms the inflow chamber 17. The third partition wall 25 is almost parallel to a mold-removing direction F2 of the second mold 32 that forms the first passage 19 and the second passage 23. Furthermore, the first to third partition walls 18, 22, and 25 are configured so that an inflow direction F3 of EGR gas from the gas chamber 7 of the EGR cooler 2 to the second passage 23 intersects with an outflow direction F4 of EGR gas through the outflow passage 21 as shown in FIG. 2. Herein, the outflow passage 21 is formed separately from the inflow chamber 17, first passage 19, and second passage 23.

The first to third partition walls 18, 22, and 25 are configured so that an inflow direction F5 of EGR gas from the upstream side into the inflow chamber 17 and an outflow direction F6 of EGR gas from the first passage 19 into the gas chamber 7 of the EGR cooler 2 are almost parallel to each other as shown in FIG. 2. Furthermore, the gas chamber 7 of the EGR cooler 2 is configured to direct the flow of EGR gas in a curved path like "U" as shown in FIGS. 1 and 2. An inflow port of the EGR cooler 2 for allowing EGR gas to flow in the gas chamber 7 is connected to the first passage 19. An outflow port of the EGR cooler 2 for EGR gas to flow out of the gas chamber 7 is connected to the second passage 23. During use of the EGR cooler device 1, moreover, as shown in FIG. 1, the valve housing 16 is oriented so that the EGR gas outflow direction F4 through the outflow passage 21 is directed to the "Bottom".

As shown in FIG. 1, the joint pipe 5 has a function of introducing EGR gas into the inflow chamber 17 of the switching valve 4 and a function of connecting with an external EGR pipe. The joint pipe 5 is therefore provided with an inlet 35 for introducing EGR gas and a diffusion chamber 36 having a semispherical shape with a larger diameter than the inlet 35. The shape and size of an opening of the diffusion chamber 36 is equal to an entrance of the inflow chamber 17 of the switching valve 4. A front end and a rear end of the joint pipe 5 are formed with flanges 5*a* and 5*b* respectively. Accordingly, EGR gas introduced in the inlet 35 of the joint pipe 5 is allowed to diffuse in the diffusion chamber 36 and smoothly flow in the inflow chamber 17 of the switching valve 4. The front-side flange 5*a* is connected to an EGR pipe continuous with an exhaust passage of an engine.

According to the aforementioned embodiment, the valve housing 16 of the switching valve 4 is configured such that the first partition wall 18, the second partition wall 22, and the third partition wall 25 are continuous with each other at the joined portion 26 in the Y-shaped cross section, the first partition wall 18 and the second partition wall 22 are slanted in a bifurcated form with respect to the mold-removing direction F1 of the first mold 31 that forms the inflow chamber 17, and the third partition wall 25 is almost parallel to the mold-removing direction F2 of the second mold 32 that forms the first passage 19 and the second passage 23. Therefore, as shown in FIG. 5, when the first mold 31 forming the inflow chamber 17 is to be removed from the molded housing 16, the mold 31 can be easily separated from the first partition wall 18 and the second partition wall 22. When the second mold 32 forming the first passage 19 and the second passage 23 is to be removed from the molded housing 16, the mold 32 can be easily separated from the third partition wall 25. Furthermore, one of the molds 31 and 32, i.e., the first mold 31 is formed with the molding parts 31*a* and 31*b* for forming the communication holes 20 and 24 respectively as shown in FIG. 5. In the molding of the first and second partition walls 18 and 22, the communication holes 20 and 24 are made at the same time when the molds 31 and 32 are removed from the housing 16. Consequently, since the partition walls 18 and 22 having the communication holes 20 and 24 are formed in the valve housing 16, such configuration can facilitate integral molding by removal of the molds 31 and 32. In the present embodiment, therefore, the number of processes can be reduced, thereby saving a manufacturing cost of the switching valve 4 by just that much, as compared with the configuration that the communication holes 20 and 24 are formed in an additional process.

In the present embodiment, as shown in FIG. 2, the EGR gas inflow direction F5 into the inflow chamber 17 of the valve housing 16 and the EGR gas outflow direction F6 out of the first passage 19 are almost parallel to each other, so that the EGR gas flow direction does not much change. Thus, pressure loss of the EGR gas flowing from the switching valve 4 to the EGR cooler 2 is reduced and accordingly the flow amount of the EGR gas allowed to pass through the EGR cooler 2 can be increased.

In the present embodiment, in use of the EGR cooler device 1 shown in FIG. 1, the valve housing 16 is oriented so that the direction F4 of EGR gas flowing out through the outflow passage 21 is directed to the "Bottom". This orientation allows flocculated water to flow down out of the housing 16 through the outflow passage 21 without staying in the second passage 23 of the housing 16 and the gas chamber 7 of the EGR cooler 2. The EGR cooler 2 and the housing 16 can therefore be prevented from corroding.

Second Embodiment

Next, a second embodiment of a switching valve for an EGR cooler according to the present invention will be described below with reference to the accompanying drawings.

In the following description, similar or identical parts or components to those in the first embodiment are given the same reference signs as those in the first embodiment. The following explanation is focused on differences from the first embodiment.

Figure 6:
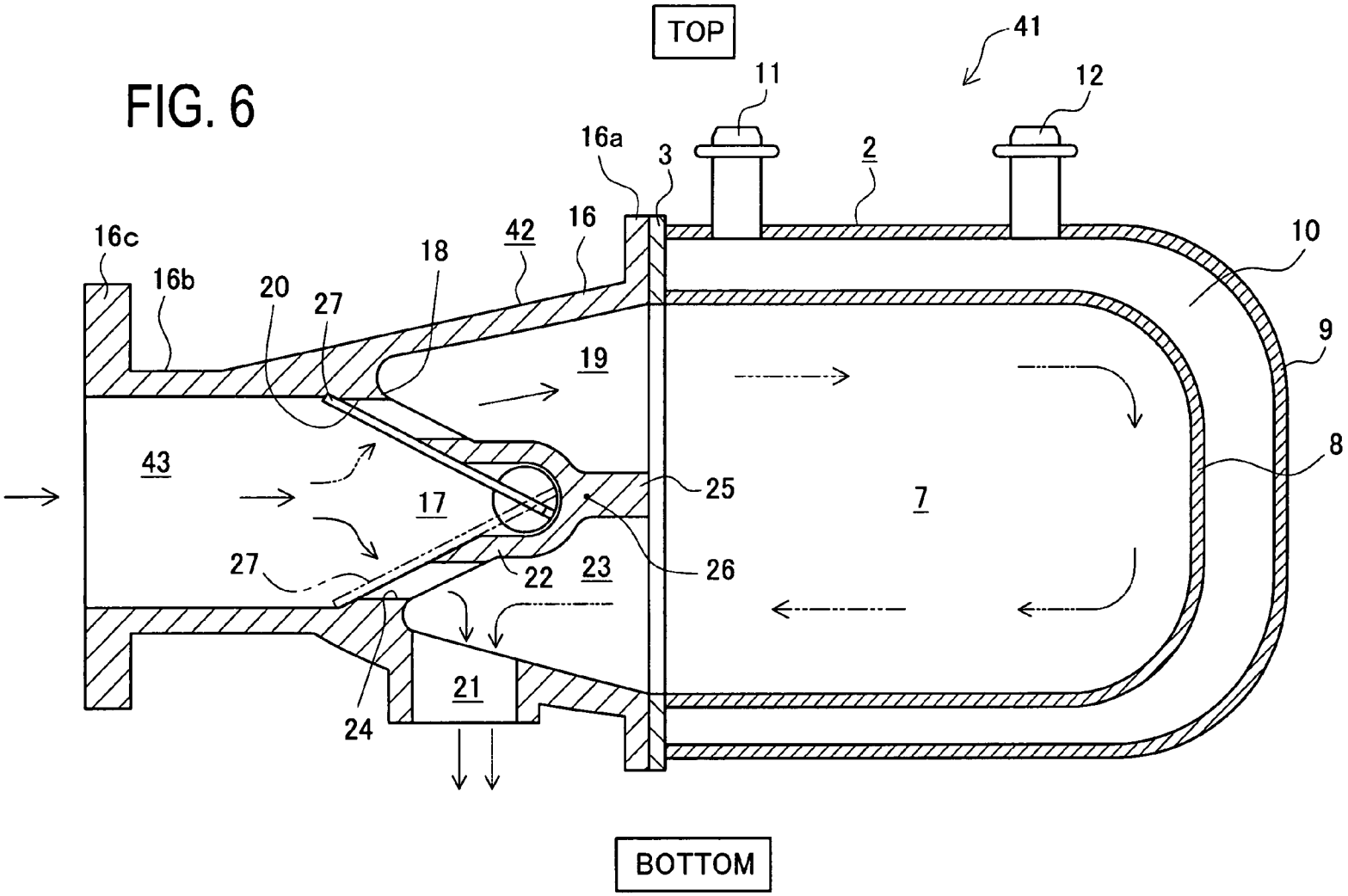
FIG. 6 is a cross sectional view of an EGR cooler in a second embodiment.

FIG. 6 is a cross sectional view of an EGR cooler device 41 in this embodiment. The orientation of this device 41 with respect to "Top" and "Bottom" in use is as shown in FIG. 6. This device 41 includes the EGR cooler 2 and a switching valve 42 fixed to the cooler 2 to switch the flow direction of EGR gas with respect to the cooler 2. The EGR cooler 2 and the switching valve 42 are fastened to each other with bolts (not shown) or the like through the gasket 3.

Figure 7:
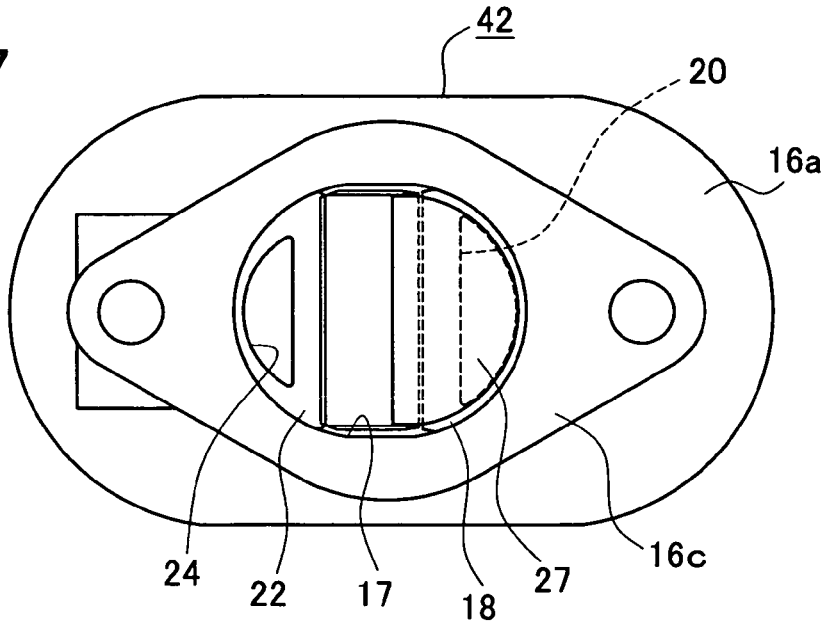
FIG. 7 is a plan view of a switching valve in the second embodiment.
Figure 8:
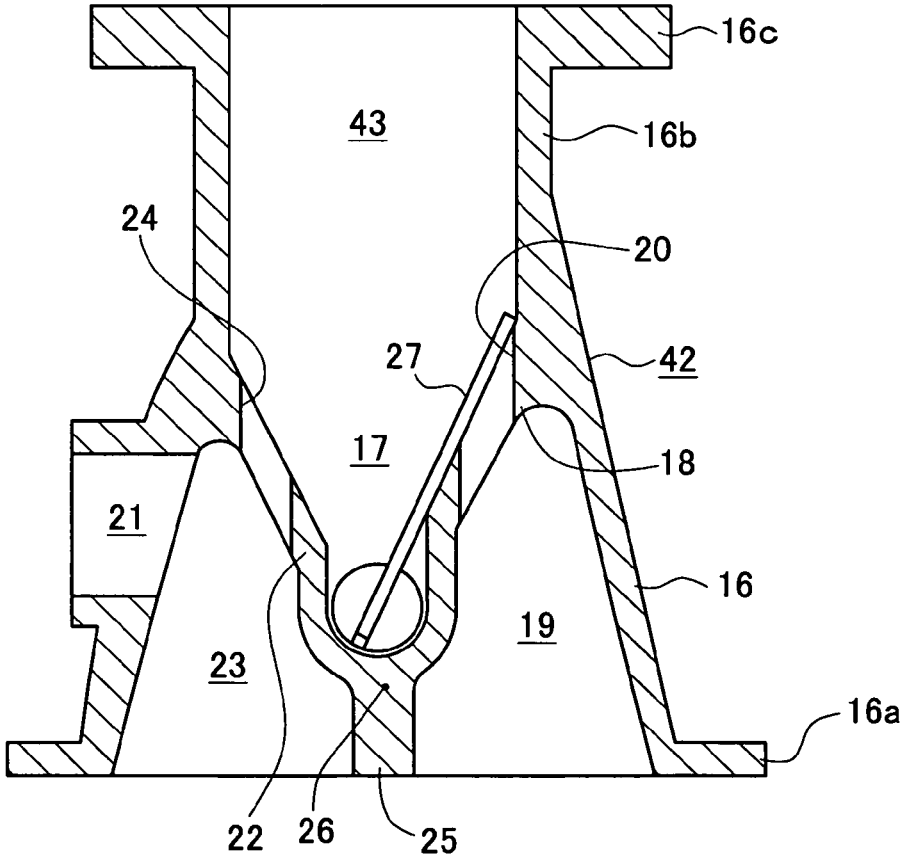
FIG. 8 is a cross sectional view of the switching valve in the second embodiment.

FIG. 7 is a plan view of the switching valve 42. FIG. 8 is a cross sectional view of the switching valve 42. The switching valve 42 in the second embodiment is different from the switching valve 4 in the first embodiment in that the valve 42 integrally has the function of the joint pipe 5 instead of eliminating the joint pipe 5 in the first embodiment. The valve housing 16 in the second embodiment includes an introduction passage 43 extending from the inflow chamber 17 to the upstream side. For this introduction passage 43, the housing 16 is integrally formed with a cylindrical joint pipe portion 16*b* in a front end portion. A front end of this joint pipe portion 16*b* is formed with a flange 16*c*. Other configurations in this embodiment are basically identical to those in the first embodiment.

Figure 9:
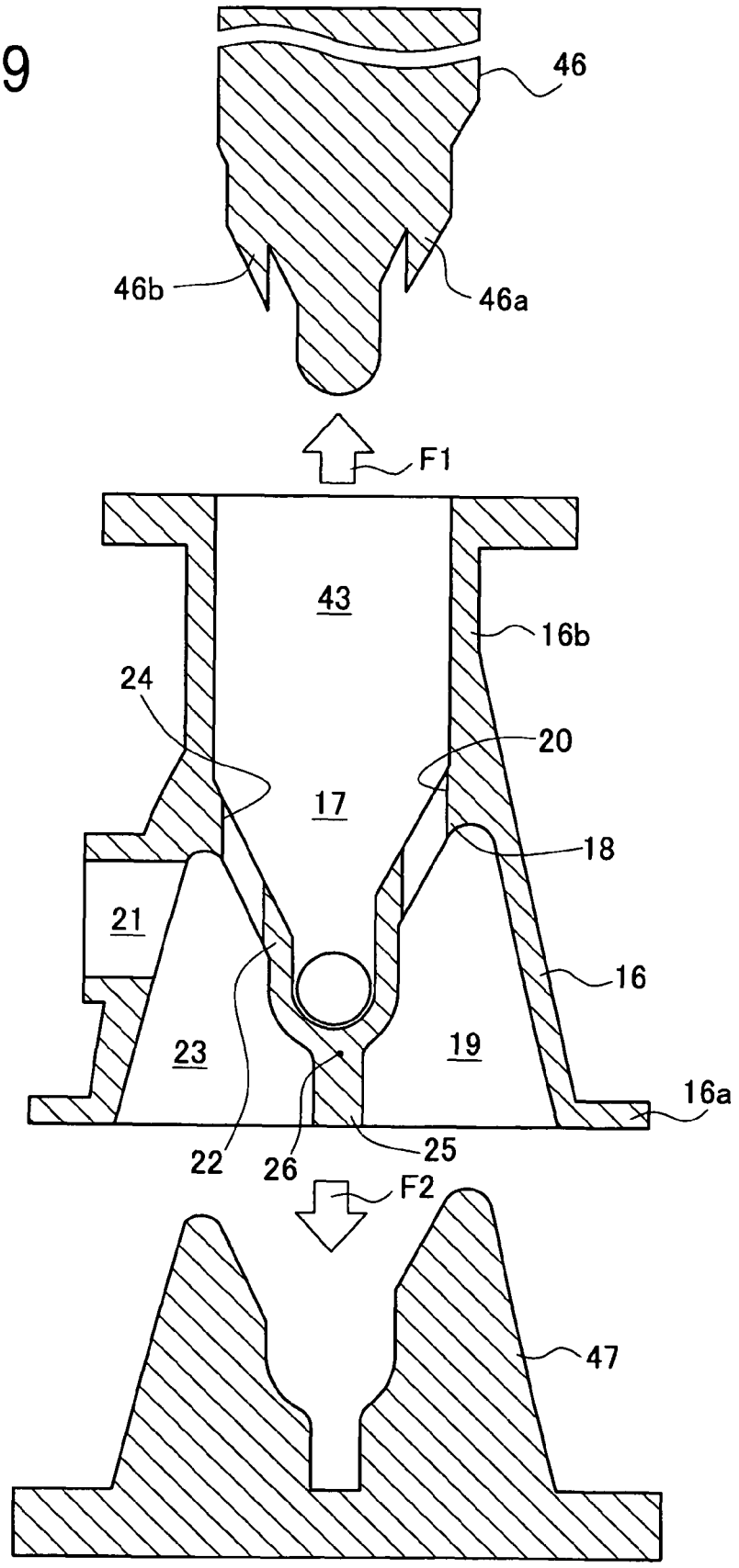
FIG. 9 is a cross sectional view showing a relationship between a valve housing and a mold for molding the housing.
Figure 10:
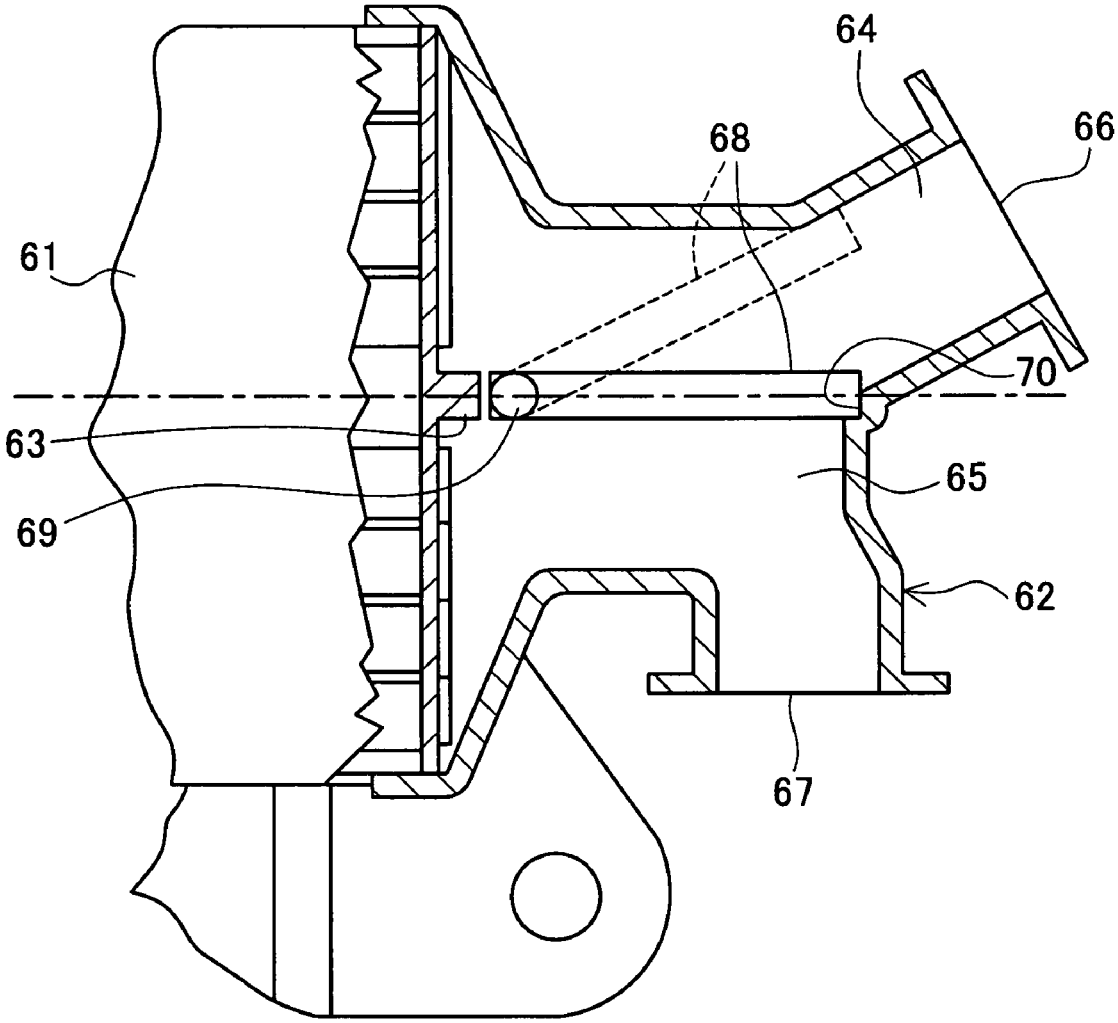
FIG. 10 PRIOR ART
FIG. 10 is a cross sectional view showing a part of a heat-exchanger in a prior art.

FIG. 9 is a cross sectional view showing a relationship between the valve housing 16 and a first mold 46 and a second mold 47 for molding the housing 16. The first mold 46 is configured to mainly form the introduction passage 43 and the inflow chamber 17 of the housing 16. The second mold 47 is configured to mainly form the first passage 19 and the second passage 23 of the housing 16. The first mold 46 is integrally formed with molding parts 46*a* and 46*b* for forming the first communication hole 20 and the second communication hole 24. Both the molds 46 and 47 are clamped and between them molten metal is supplied. Thus, the first partition wall 18, second partition wall 22, and third partition wall 25 are formed continuously in a Y-shaped cross section. In addition, the first partition wall 18 and the second partition wall 22 are formed with the first communication hole 20 and the second communication hole 24 respectively. Herein, the first partition wall 18 and the second partition wall 22 are slanted with respect to the mold-removing direction F1 of the first mold 46 that forms the introduction passage 43 and the inflow chamber 17. The third partition wall 25 is almost parallel to the mold-removing direction F2 of the second mold 47 that forms the first passage 19 and the second passage 23. Furthermore, the first to third partition walls 18, 22, and 25 are configured so that an inflow direction of EGR gas from the gas chamber 7 of the EGR cooler 2 to the second passage 23 intersects with the outflow direction of the EGR gas through the outflow passage 21. Herein, the outflow passage 21 is formed separately from the inflow chamber 17, first passage 19, and second passage 23.

In the second embodiment, similarly to the first embodiment, when the first mold 46 forming the introduction passage 43 and the inflow chamber 17 is to be removed from the molded housing 16, the first mold 46 can be easily separated from the first partition wall 18 and the second partition wall 22 as shown in FIG. 9. When the second mold 47 forming the first passage 19 and the second passage 23 is to be removed from the molded housing 16, the second mold 47 can be easily separated from the third partition wall 25. As shown in FIG. 9, furthermore, one of the molds 46 and 47, i.e., the first mold 46 is formed with the molding parts 46*a* and 46*b* for forming the communication holes 20 and 24. Accordingly, in the molding of the first and second partition walls 18 and 22, the communication holes 20 and 24 are made simply at the same time when the molds 46 and 47 are removed from the housing 16. Consequently, since the partition walls 18 and 22 having the communication holes 20 and 24 are formed in the valve housing 16, such configuration can facilitate integral molding by removal of the molds 46 and 47. In the present embodiment, therefore, the number of man-hours can be reduced, thereby saving a manufacturing cost of the switching valve 42 by just that much as compared with the configuration that the communication holes 20 and 24 are formed in an additional process.

Other operations and effects of the switching valve 42 in the second embodiment are the same as those of the switching valve 4 in the first embodiment.

The present invention is not limited to the aforementioned embodiment and may be embodied in other specific forms without departing from the spirit or essential characteristics thereof.

In the above embodiments, the first mold 31 or 46 and the second mold 32 or 47 are used to form the valve housing 16. The molding parts 31*a* and 31*b* or 46*a* and 46*b* for forming the first and second communication holes 20 and 24 in the housing 16 are provided in only the first mold 31 or 46. Alternatively, such molding parts may be provided in only the second mold or in both the first and second molds.

In the above embodiments, the valve housing 16 is made of metal such as aluminum. As an alternative, at least a valve housing of the switching valve may be made of resin, heat-hardening resin (bakelite-phenol resin), or others having a heat resistance property. The valve housing made of resin can have an internal surface in a mirror-smooth state as compared with the valve housing 16 made of metal. Thus, carbon particles or the like contained in EGR gas are hard to stick to such internal surface. In this case, a heat resistance property of the resin valve housing will not cause any problems only if it has an allowable temperature limit of about 200° C.

INDUSTRIAL APPLICABILITY

The present invention can be applied to an EGR device including an EGR cooler to be provided in an engine.

While the presently preferred embodiment of the present invention has been shown and described, it is to be understood that this disclosure is for the purpose of illustration and that various changes and modifications may be made without departing from the scope of the invention as set forth in the appended claims.

REFERENCE SIGNS LIST

1 EGR cooler device
2 EGR cooler
4 Switching valve
16 Valve housing
17 Inflow chamber
18 First partition wall
19 First passage
20 First communication hole
21 Outflow passage
22 Second partition wall
23 Second passage
24 Second communication hole
25 Third partition wall
26 Joined portion
27 Valve element
31 First mold
32 Second mold
41 EGR cooler device
42 Switching valve
46 First mold
47 Second mold
F1 Mold-removing direction
F2 Mold-removing direction
F3 Inflow direction
F4 Outflow direction
F5 Inflow direction
F6 Outflow direction

The invention claimed is:

1. A switching valve for EGR cooler, the valve being to be provided in the EGR cooler to switch a flow direction of EGR gas with respect to the EGR cooler, the valve comprising:

a valve housing molded by a mold and to be fixed to the EGR cooler;

an inflow chamber formed in the valve housing so that EGR gas flows therein from an upstream side of the valve housing;

a first passage formed in the valve housing to be adjacent to the inflow chamber through a first partition wall and to communicate with inside of the EGR cooler;

a first communication hole formed in the first partition wall to provide communication between the inflow chamber and the first passage;

an outflow passage through which EGR gas flows out of the valve housing to a downstream side thereof;

a second passage formed in the valve housing to communicate with the outflow passage and be adjacent to the inflow chamber through a second partition wall, and communicate with the inside of the EGR cooler;

a second communication hole formed in the second partition wall to provide communication between the inflow chamber and the second passage;

a third partition wall dividing the first passage from the second passage, the first partition wall, the second partition wall, and the third partition wall being continuous to each other at a joined portion, forming a Y-shaped cross section; and a valve element placed to be swingable about a point near the joined portion between the first partition wall and the second partition wall, the valve element being swung to selectively close the first communication hole and the second communication hole, and the first partition wall and the second partition wall being slanted with respect to a mold-removing direction of a mold that forms the inflow chamber, and the third partition wall being almost parallel to a mold-removing direction of another mold that forms the first passage and the second passage.

2. The switching valve for EGR cooler according to claim 1, wherein the first, second, and third partition walls are formed so that an inflow direction of EGR gas into the inflow chamber is almost parallel to an outflow direction of EGR gas out of the first passage.

3. The switching valve for EGR cooler according to claim 1, wherein the valve housing is oriented in use so that the EGR gas flows in a curved path like "U" in the EGR cooler, the first passage is connected to an inflow port of the EGR cooler through which the EGR gas flows in the EGR cooler, the second passage is connected to an outflow port of the EGR cooler through which the EGR gas flows out of the EGR cooler, an EGR gas inflow direction into the second passage intersects with an EGR gas outflow direction from the outflow passage, and the EGR gas outflow direction from the outflow passage is directed to a bottom.

4. The switching valve for EGR cooler according to claim 2, wherein the valve housing is oriented in use so that the EGR gas flows in a curved path like "U" in the EGR cooler, the first passage is connected to an inflow port of the EGR cooler through which the EGR gas flows in the EGR cooler, the second passage is connected to an outflow port of the EGR cooler through which the EGR gas flows out of the EGR cooler, an EGR gas inflow direction into the second passage intersects with an EGR gas outflow direction from the outflow passage, and the EGR gas outflow direction from the outflow passage is directed to a bottom.

5. The switching valve for EGR cooler according to claim 1, wherein the valve housing includes an introduction passage extending from the inflow chamber to an upstream side of the valve housing and further integrally includes a cylindrical joint pipe portion in a front end portion to define the introduction passage, and the first and second partition walls are slanted with respect to a mold-removing direction of a mold that forms the inflow chamber and the introduction passage and the third partition wall is almost parallel to a mold-removing direction of a mold that forms the first passage and the second passage.

* * * * *